United States Patent [19]

Petersen

[11] Patent Number: 4,913,131

[45] Date of Patent: Apr. 3, 1990

[54] FACADE/FACING FOR ZERO CLEARANCE FIREPLACE

[76] Inventor: Joseph A. Petersen, P.O. Box 16124, Shawnee Mission, Kans. 66203

[21] Appl. No.: 12,073

[22] Filed: Feb. 6, 1987

[51] Int. Cl.[4] ..... F24C 15/00; F24C 15/06

[52] U.S. Cl. ..... 126/544; 126/500

[58] Field of Search ..... 126/138, 139, 121, 202, 126/500, 544

[56] References Cited

U.S. PATENT DOCUMENTS

| | | | |
|---|---|---|---|
| 2,131,763 | 10/1938 | Sroat | 126/121 |
| 3,870,032 | 3/1975 | Lydle et al. | 126/202 |
| 4,700,687 | 10/1987 | Bailey | 126/139 |

*Primary Examiner*—Carl D. Price

*Attorney, Agent, or Firm*—Thomas M. Scofield

[57] ABSTRACT

The provision of an add-on, complete, decorative front facing or facade for zero clearance metal fireplaces; a complete, decorative metal fit-on facade or facing for a zero clearance metal fireplace where the facing/facade is made up of individual, discrete, horizontal and vertical metal panels and the said individual vertical and horizontal panel members interfit and engage with one another and the structure of the zero clearance fireplace in order to permit the element by element assembly or application of the facing/facade and, further, to effectively hold the panel members together upon assembly; a system of providing a full frontal facade or metal panel facing for a zero clearance fireplace, such made up of individual vertical and horizontal panel and grill facing members applicable to a standard zero clearance fireplace front at any time after the latter is installed, thus to drastically improve the appearance of the fireplace front.

13 Claims, 5 Drawing Sheets

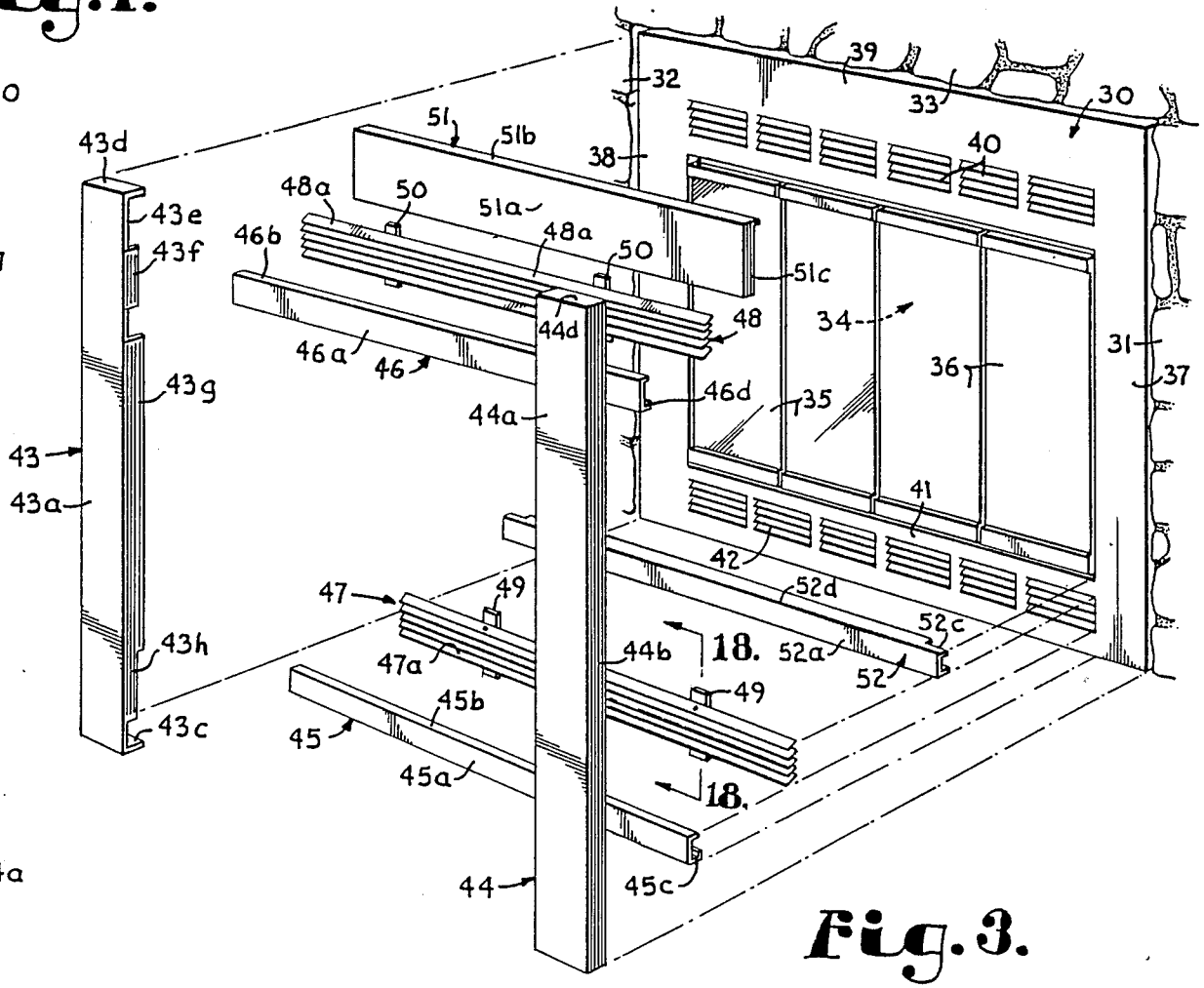
Fig. 3.
Fig. 1.
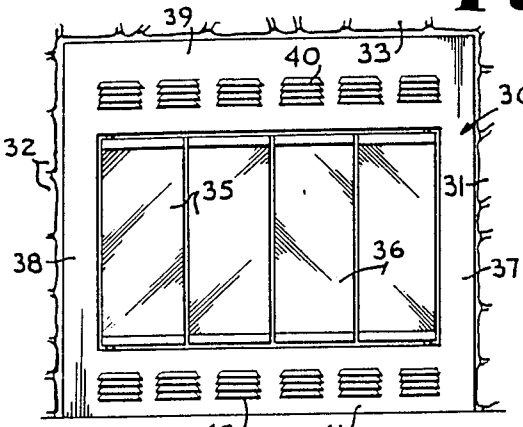
Fig. 2.
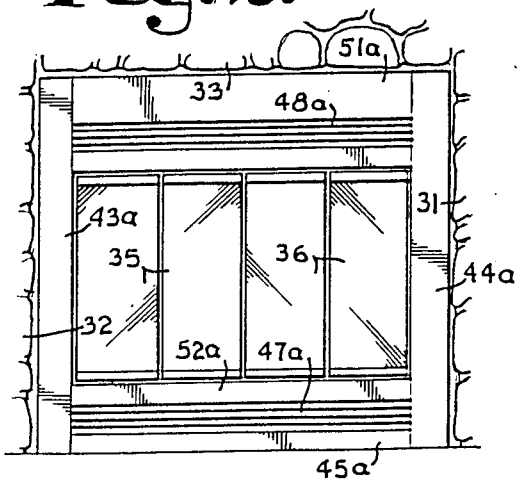

Fig. 21.
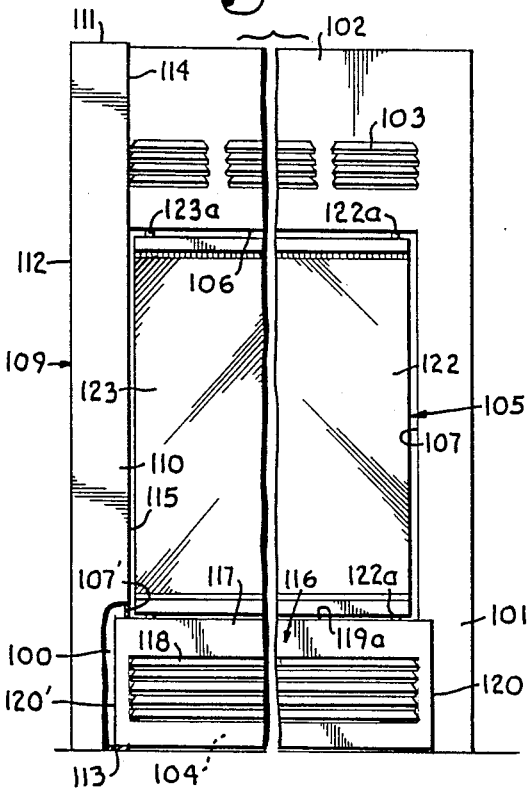
Fig. 22.
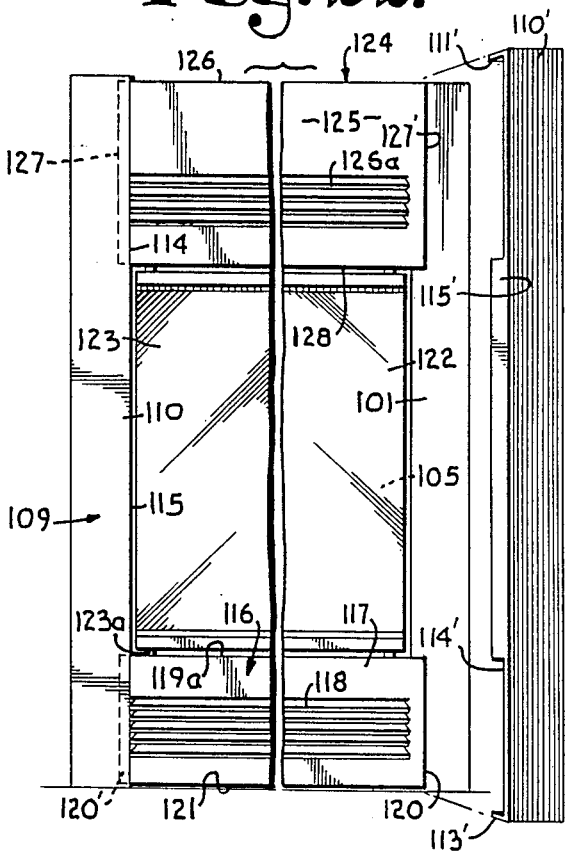
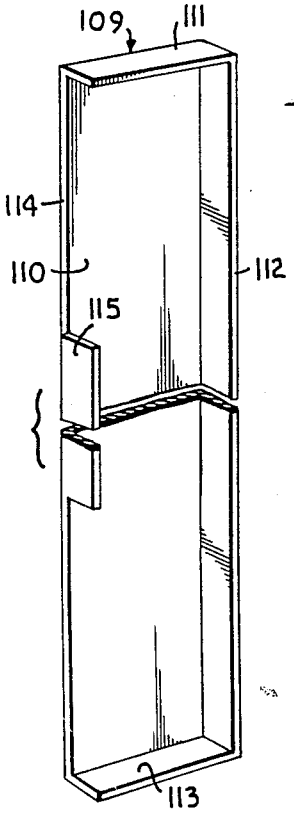
Fig. 23.
Fig. 25.
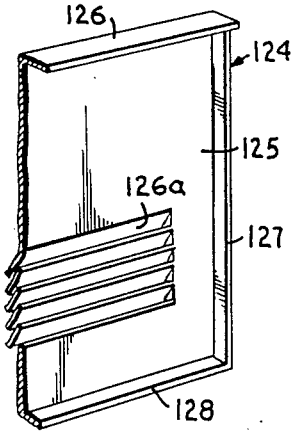
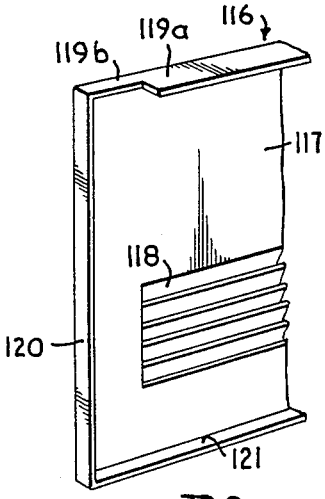
Fig. 24.

FACADE/FACING FOR ZERO CLEARANCE FIREPLACE

BACKGROUND OF THE INVENTION

Zero clearance fireplaces are well known to the industry and art. The terminology means that such metal fireplaces can be installed in a wood surround without any additional insulation or protection. It is further well known to provide such zero clearance fireplaces for initial installation already supplied with different types of decorative metal fronts for appearance purposes. Such would include, for example, a polished brass fronting, among many other options. However, the provision of a zero clearance fireplace with an integral, original decorative or polished metal fireplace front is quite expensive. Accordingly, there has been some effort made in the past to provide at least partial, add-on, front facade members or facing members which, being made of brass or other decorative metal, will improve at lest somewhat the typical black metal front appearance of the basic zero clearance fireplace.

Heretofore, to the best knowledge of the applicant, there has not been provided any full front coverage, add-on, zero clearance fireplace facade or facing. Particularly, there has not been provided such a facing which is constructed of elements which may be engaged and interfitted with one another so the entire assembly is mounted and supported firmly and safely with respect to the fireplace front without elaborate connection means engaging the zero clearance fireplace front or side walls. Optionally, a few self-driving metal screws may be employed with respect to the construction in assembly, depending on the owner's choice and circumstances.

It is also not believed that such a complete add-on decorative facade or facing for a zero clearance metal fireplace has ever been provided which will readily adapt to either louvres or grills positioned both above and below the fireplace opening or simply one set of louvres or grill located above the fireplace opening. Such, however, is the case with respect to the subject development and invention. In addition to brass, other finishes, such as chrome, aluminum, brushed steel, etc. may be employed without changing the basic function, attachment and operation of the add-on facing or facade.

THE PRIOR ART

Applicant is aware of the following patents directed to add-on elements for fireplace and mantel fronts.

Page 269,536 "Portable Mantle For Fireplaces" issued Dec. 26, 1982;

Graves 418,788 "Sheet Metal Mantel", issued Jan. 7, 1890;

Lydle 3,459,173 "Fireplace Front Or Screen" issued Aug. 5, 1969;

Design Patent 249,059, Moncreiff-Yeates "Fireplace Unit" issued Aug. 22, 1978;

Livesay 4,231,349 issued Nov. 4, 1980 for "Fireplace Heat Exchanger Unit";

Dew Reissue 30,437 "Corner Assembly For Fireplace Enclosure", reissued Nov. 18, 1980;

Wright et al 4,254,596 "Assemblable Mantle Piece", issued Mar. 10, 1981;

Engleman 4,256,084 "Device For Supplying . . . " issued Mar. 17, 1981;

Hempel 4,280,473, issued July 28, 1981 for "Fireplace Having An Outside Air Supply";

Taylor 4,519,377, issued May 28, 1985 for "Fireplace Heat Transfer Apparatus.

As an example of a zero clearance fireplace which offers, as an original (not add-on) option, an all brass front, reference is made to the advertisement of Heat-N-Glo Fireplaces, 3850 W. Highway 13, Burnsville, M.N. 55337 entitled "The Energy Master", the advertisement received Mar. 18, 1985 in USPTO Group 290. Reference is also made to the advertisement of New Buck Corporation, 328 Spruce Pine Shopping Center, Spruce Pine, N.C. 28777 which shows a zero clearance fireplace with a special facing. (Received Mar. 18, 1985 in Group 290.) Reference is further made to the Heatilator Inc. advertisement (two pages), address 1915 W. Saunders Road, Mount Pleasant, I.A. 52641 disclosing, for a zero clearance fireplace, an "Optional Solid Brass Trim Kit". This advertisement was received Mar. 18, 1985 in Group 290. Applicant also has the advertisement of Woodside (address unknown) referring to an "X-Pander" which "Accents Your Decor With Colorful Face Plates", this advertisement received Mar. 16, 1984 in Group 290, the fragment of the advertisement copied by applicant's searcher not showing or describing such any further.

Applicant also possesses a leaflet of Superior, 4325 Artesia Avenue, Fullerton, CA 92633 showing brass paneling which may be an add-on option or original construction, the disclosure not being clear. Also, please note applicant has a leaflet of Beckwood Industries Inc. 889 Horan Drive, Fenton, MO 63026 which shows a partial add-on fireplace surround mounted with respect to a zero clearance fireplace. Numerous other advertisements showing integral, original (not add-on) decorative fireplace fronts are in applicant's hands.

OBJECTS OF THE INVENTION

A first object of the invention is to provide a new apparatus array and method of assembly thereof directed to the provision of a complete, zero clearance fireplace decorative front facade or facing.

Another object of the invention is to provide such a zero clearance fireplace facing or facade which is addable to the originally installed zero clearance fireplace front at any time after installation of the latter with a minimum of problems, effort and troubles.

Yet another object of the invention is to provide such a complete facing or facade for a zero clearance fireplace front wherein the facing or facade (or parts thereof) may readily be removed for access to any part of the fireplace front for any purpose whatsoever, such as access to blowers, fans or the like, the removable parts of the paneling system being thereafter easily returnable to original, applied position upon completion of the task for which access was desired.

Another object of the invention is to provide later add-on complete facings and facades for zero clearance fireplaces which are much cheaper, for a particular metal finish, than providing such originally in the zero clearance fireplace structure and which may be installed by the owner of the fireplace with a minimum of difficulty, problems and effort.

Another object of the invention is to provide new, complete facings and facades for zero clearance fireplaces which have either two grills (both above and below the fireplace opening) or but a single grill opening (only above the fireplace opening) with a minimum of revision to the parts and system.

Yet another object of the invention is to provide such complete, add-on facings and facades for zero clearance fireplaces which may be packed, shipped and transported in knock-down, disassembled form for minimum cost, safety, bulk and the like.

Still another object of the invention is to provide such complete, add-on facings and facades for zero clearance fireplaces which may be provided with absolutely straight and unwavering louvers with respect to the upper and lower portions of the facade due to the fact that the louvres are constructed as a separate entity from the panel portions thereabove and therebelow, thus not suffering from the distortion common when slots or louvres are formed in a metal sheet.

Another object of the invention is to provide such a complete facing or facade for a zero clearance fireplace wherein but four pieces or panel members need be employed to face the entire fireplace, thus minimizing time of assembly and disassembly and maximizing convenience of assembling and disassembly.

Yet another object of the invention is to provide a new apparatus array and method of assembly thereof directed to provision of a complete, zero clearance fireplace decorative front facade or facing wherein one of the horizontal members of the facade may be a single piece member (either upper or lower), while the other horizontal member (upper or lower) may be made up of multiple pieces whereby to provide the most satisfactory louvre structure.

Yet another object of the invention is to provide such a new apparatus array and method of assembly thereof directed to the provision of a complete, zero clearance fireplace decorative front or facing, wherein the said facade or facing is extremely versatile with respect to the horizontal members which are used therewith.

Other objects of the invention will appear in the course of the following description thereof.

THE DRAWINGS

In the drawings, which form a part of the instant specification and are to be read in conjunction therewith, embodiments of the invention are shown and, in the various views, like numerals are employed to indicate like parts.

FIG. 1 is a front view of a standard, typical zero clearance fireplace installed in an opening in a wall but without any of the elements of the subject inventive, decorative facade or facing yet applied thereto; this fireplace having two sets of louvres or grills, one set below the fireplace opening and one set thereabove. The zero clearance fireplace illustrated also has a pair of standard, openable glass doors thereon which is preferred, but are not required in this type of fireplace.

FIG. 2 is a view like that of FIG. 1 but with all the elements of the subject facing or facade actually applied to the front of the zero clearance fireplace and in place.

FIG. 3 is an exploded three quarter perspective view from above of the zero clearance fireplace front of FIG. 1 with the facade or facing elements applied in FIG. 2 positioned outwardly therefrom relative to their place and position of application. (This is a three-quarter perspective view from the right hand side of FIGS. 1 and 2, looking somewhat downwardly on the zero clearance fireplace front and the facing elements positioned outwardly with respect thereto.)

Figure 6:
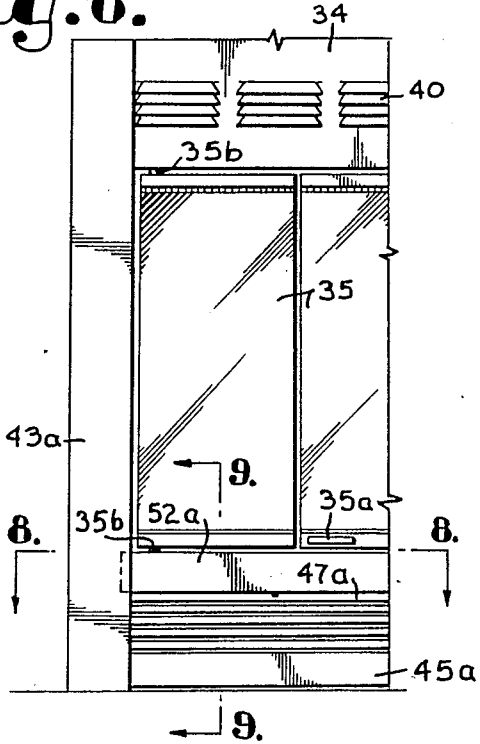
Figure 5:
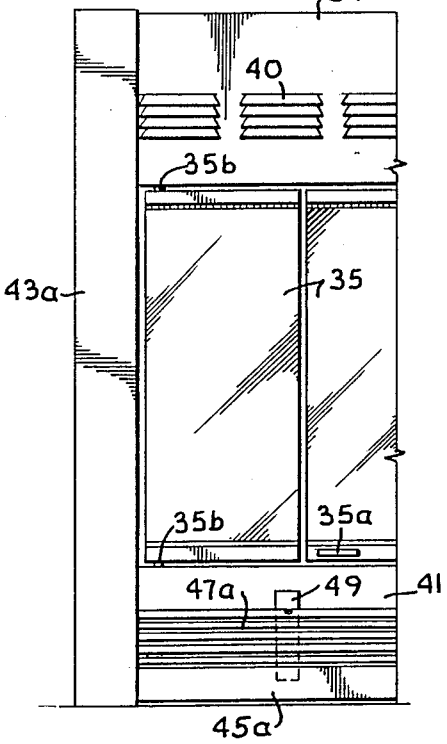
FIG. 5 is a view like that of FIG. 4 (a fragmentary front view of the left side of the fireplace of FIG. 1) with a second element added to the assembly, specifically, the lower grill (bottom two).
Figure 4:
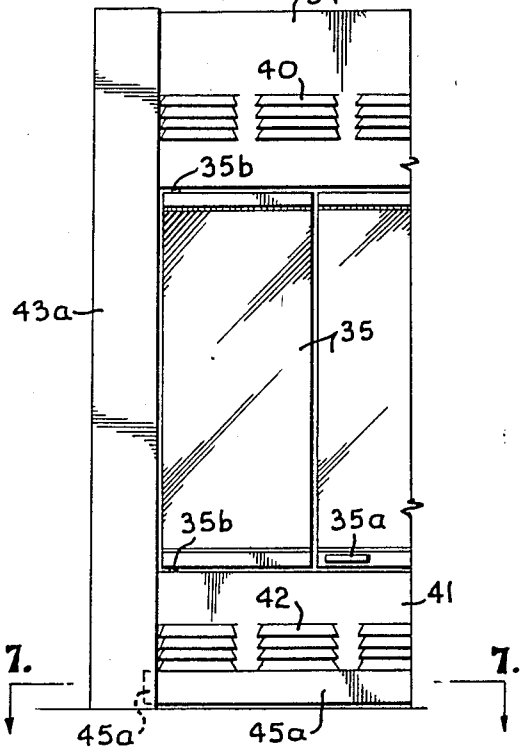
FIG. 4 is a fragmentary front view of the left hand side of the fireplace of FIG. 1 showing an initial stage of assembly with the left hand side vertical member or panel partly in place and the lowermost bottom panel strip (hereinafter occasionally referred to as bottom three) inserted at one end thereof.

FIG. 6 is a view like those of FIGS. 4 and 5 showing the next stage in assembly with the lower panel set's top horizontal beam (bottom one) added so that the three elements of the lower part of the assembly (bottom 1, 2 and 3) are implaced with respect to the left hand vertical panel.

Figure 7:
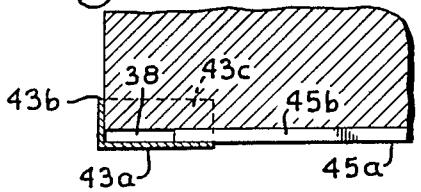

FIG. 7 is a view taken along the line 7—7 of FIG. 4 in the direction of the arrows showing the left hand vertical side member not fully engaged with the fireplace with the left hand and right hand edge parts thereof not entirely "snapped-in".

Figure 8:
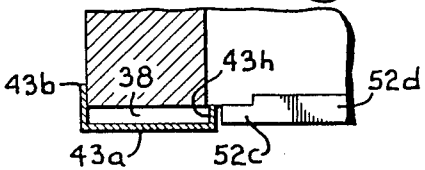

FIG. 8 is a view taken along the line 8—8 of FIG. 6 in the direction of the arrows (showing substantially the same thing as seen in FIG. 7 except that the view is taken from above the top lower horizontal beam (bottom 1)).

Figure 9:
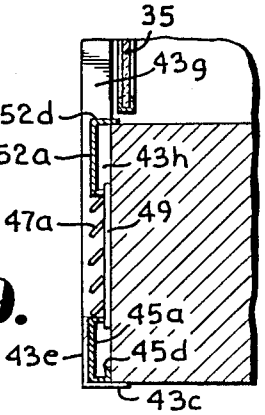

FIG. 9 is a view taken along the line 9—9 of FIG. 6 in the direction of the arrows.

Figure 10:
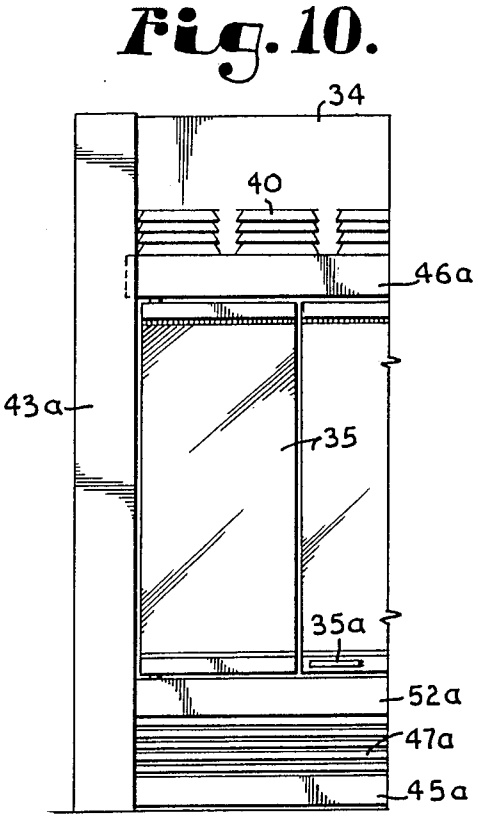

FIG. 10 is a view like those of FIGS. 4–6, inclusive, but showing the next stage in assembly with the lowermost top horizontal beam (upper or top 3) inserted with respect to the left hand vertical panel or structural.

Figure 11:
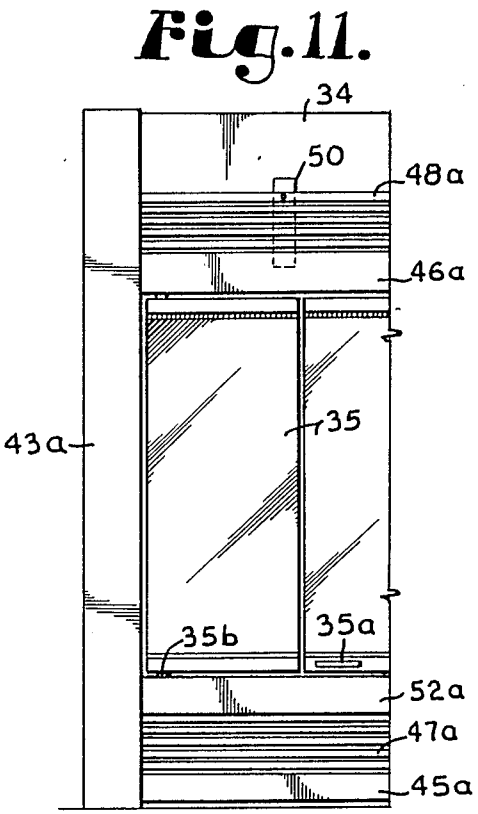

FIG. 11 is a view like that of FIG. 10 showing the next or following assembly step after that seen in FIG. 10 thus showing the upper grill (upper or top 2) inserted into place.

Figure 12:
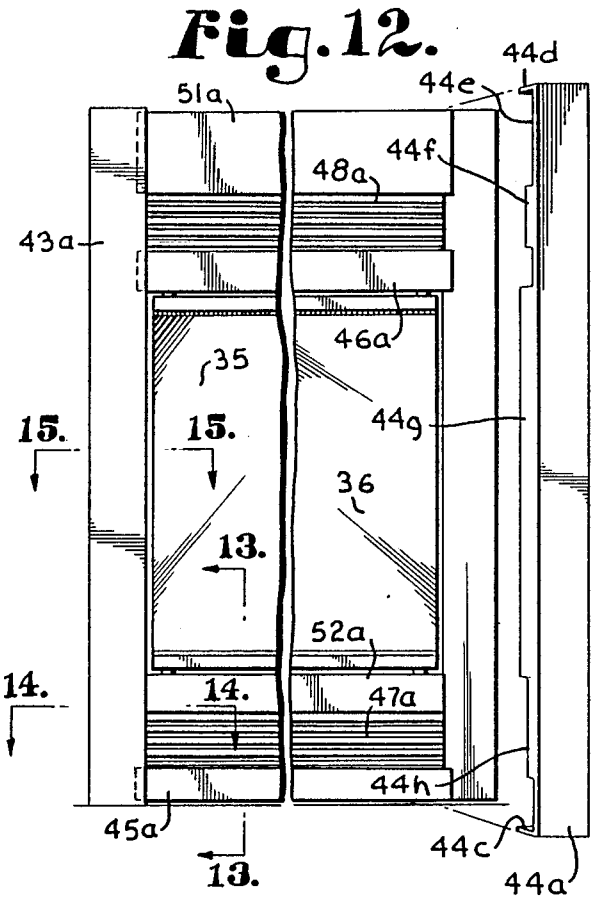

FIG. 12 is a partially exploded front view of the fireplace of FIG. 1 just before final assembly into the faced fireplace of FIGS. 2, illustrating a number of things. In the first place, all of the elements of the upper and lower horizontal member arrays (including top or upper 1) have been inserted with respect to the left hand vertical panel or beam. The left hand vertical beam has been fully inserted or snapped in with respect to the fireplace upon these six pieces. Still further, FIG. 12 shows the right hand vertical side beam ready to be applied to the fireplace front to complete the entire facing or facade.

Figure 13:
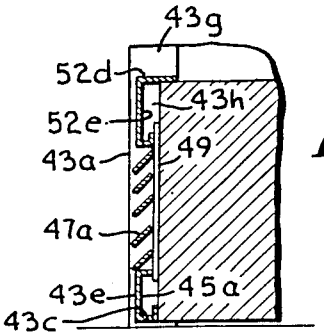

FIG. 13 is a view taken along the line 13—13 of FIG. 12 in the direction of the arrows.

Figure 14:
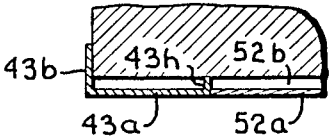

FIG. 14 is a view taken along the line 14—14 of FIG. 12 in the direction of the arrows.

Figure 15:
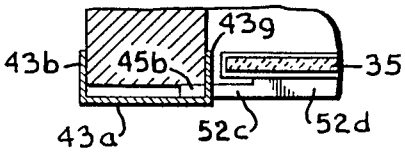

FIG. 15 is a view taken along the line 15—15 of FIG. 12 in the direction of the arrows.

Figure 16:
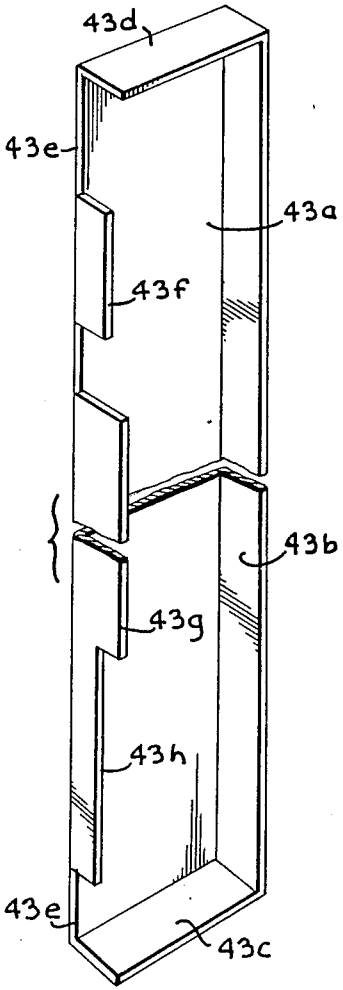

FIG. 16 is an enlarged, vertically positioned, three-quarter perspective view from above of the inboard side (towards the fireplace) of the left hand vertical structural member of the preceding figures, specifically, the first element applied in FIG. 4 and the element seen to the left in FIGS. 2 and 3.

Figure 17:
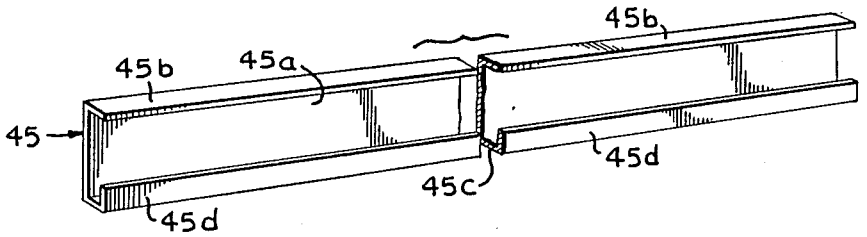

FIG. 17 is a three quarter perspective view, from above, of the inboard face of both the upper set lowest horizontal (upper or top 3) and the lower set lowest horizontal (lower or bottom 3).

Figure 18:
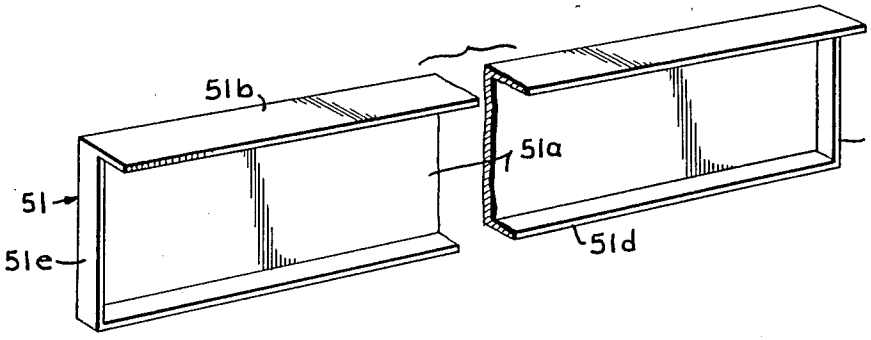

FIG. 18 is a three-quarter perspective view from above of the inboard face of the uppermost horizontal structural member (upper or top 1).

Figure 19:
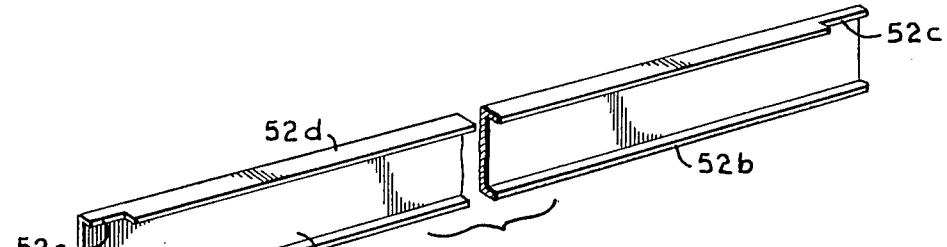

FIG. 19 is a three-quarter perspective view from above of the inboard face of the upper horizontal structural of the lower set (lower or bottom 1).

Figure 20:
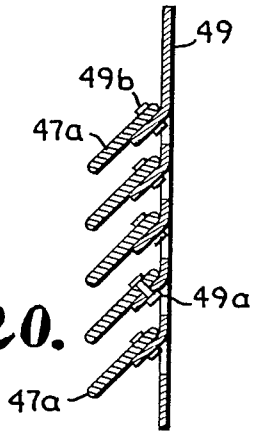

FIG. 20 is a view taken along the line 20—20 of FIG. 3 in the direction of the arrows, showing one of the two vertical members operating to assemble the horizontal louvres of the grills.

FIG. 21 is a view like that of FIG. 6 wherein the single left vertical member is implaced partially cut away at the bottom to better see the underlying construction), while the entire lower horizontal member has been implaced with respect to said fireplace front. The difference between these views is that the lower horizontal facade or covering in FIG. 21 is one piece, while that of FIG. 6 is three piece.

FIG. 22 is a front view of a zero clearance fireplace in the process of being repaneled on the front face thereof, there being shown the left vertical and both horizontal members (top and bottom above and below the firebox) in place with, on the right, there being seen a right hand vertical member about to be implaced on the right hand vertical portion of the front of the zero clearance fireplace. This view is closely analogous to that of FIG. 12, differing from FIG. 12 in that both the horizontal upper and lower members are one piece, rather than each being of three pieces as seen in FIG. 12.

FIG. 23 is an enlarged, vertical positioned, three-quarter perspective view from above of the inboard side (towards the fireplace) of the left hand vertical structure member of FIGS. 1 and 22. This view should be compared with FIG. 16, as the structure is the same except for the fact that the new half depth flanges are removed from the construction of FIG. 16 (on the left hand side thereof in the view).

FIG. 24 is a three-quarter perspective view from above of the right hand end of the lower horizontal facade member of FIGS. 21 and 22 showing the side and bottom flanges that abut against the zero clearance fireplace front wall and the upper full depth flange which overlies the floor of the firebox centrally of the member in question.

FIG. 25 is a three-quarter perspective view taken from above of the left hand upper corner of the upper horizontal member seen centrally of FIG. 22, this view showing, in addition to the slots in the front panel thereof, the half depth flanges that abut against the front wall of the fireplace on the sides and bottom thereof, together with the full depth flange at the top of said member which overlies the top of the zero clearance fireplace and, at the left and right extremities thereof, underlies the top flange of the vertical panel members.

STRUCTURE, ELEMENTS, ASSEMBLY AND ASSEMBLAGE

Referring first to FIG. 1 and also the right hand center of FIG. 3, therein is shown a typical zero clearance fireplace whose front is generally designated 30. The fireplace unit is shown as already mounted in a wall opening having side wall portions 31 and 32 and top horizontal opening portion 33. Front 30, in a zero clearance fireplace of standard construction, is finished typically as black metal. It is understood that, if the buyer wishes to go to the initial expense, he can purchase a zero clearance fireplace with an already integral front wall or panel of brass, brushed steel, aluminum or other metal character. In such case, the instant add-on facade or facing would not be employed.

The illustrated fireplace has fireplace opening 34 behind the operable and closeable conventional glass door sections 35 and 36. These typically fold outwardly and laterally to give full access to the center and side portions of the fireplace opening. The details of structure and variations of structure of various market available types of zero clearance fireplaces are not significant here, such being taken for granted as prior art. The fireplace door sections typically have pivotable post mountings at the outboard upper and lower ends of the laterally outmost framed glass panes or panels. There may also be provided door clips on the outboard base portions of the fireplace opening to aid in retaining the doors closed, such typically positioned underneath the bottom portions of the doors (when closed) adjacent to the pivotal mountings thereof. This is also standard prior art structure.

The zero clearance fireplace standard or conventional black metal front shown in FIG. 1 and the right center of FIG. 3 has lateral vertical wall portions 37 and 38 laterally positioned of the fireplace opening 34, as well as upper horizontal sheet or plate 39 having a first set of louvres 40 therewithin. Lower horizontal plate or sheet member 41 may have a second set of louvres 42 formed therewithin. With this construction (two sets of louvres, one above and one below the fireplace opening), the lower louvres 42 are typically air intake openings leading to blowers or fans, while the upper louvre set 40 comprises air output or outflow openings. In the event that a blower system is not employed with the zero clearance fireplace, lower louvres 42 will not be present, but upper louvres 40 will be.

It also should be understood that there is sufficient clearance between the top of the zero clearance fireplace unit and wall portion 33 that a thin, sheet metal edge (to be described) may be slid in over the top of front wall portion 39 under upper surround 33. Yet further, there is sufficient wall clearance between surround wall portion 32 and the lateral edge of vertical member 38, as well as between surround wall portion 31 and the lateral edge of vertical side panel 37 that, again, a thin edge portion of sheet metal may be inserted between the periphery of the zero clearance fireplace structure and the side, vertical surround wall portions 31 and 32. Finally, there is sufficient clearance underneath the two folding door sections 35 and 36 (centrally of the side edge mountings thereof) that, again, a thin sheet of metal may slide under the glass doors on the base of the fireplace opening 34 for purposes to be described. In the latter case, the above mentioned door clips may have to be removed prior to such insertion, typically to be returned to partially overlie the said metal sheet after it is inserted under doors 35 and 36. The noted described conditions and spacings are not unusual, in fact, they are, in almost every case, exactly the situation.

Referring particularly to FIGS. 3, 12 and 16–20, inclusive the normally vertical and horizontal elements of applicant's facing or facade for a zero clearance fireplace will be first described. For purposes of relative measurements (not absolute), it is assumed that the width of the fireplace opening (from the inboard edges of perpendicular panels 37 and 38 in FIG. 1) is 36 inches.

On the left hand side of FIG. 3 and in FIG. 16, there is seen a vertical member generally numbered 43. Member 43 has front elongate rectangular panel 43*a*, vertical outboard inwardly extending side edge or flange 43*b*, inwardly extending lower edge or flange 43c and inwardly extending upper edge or flange portion 43d. The height of member 43 from its bottom edge to its top edge, again for comparative purposes, is approximately 40 inches. The inward extensions (at right angles to outer panel 43a) of edge portions 43b, 43c and 43d are each approximately one inch. On the inboard edge 43e of front panel 43a there are provided short tab 43f, flange 43g and elongate tab 43h.

Tab 43f is typically 3 ¾ inch long and ½ inch in depth. From the top edge of flange 43f to top edge 43d is approximately 6 inches. From the bottom edge of tab 43f to the top edge of flange 43g is approximately 2 inches.

Flange 43g is typically approximately 22 inches long and one inch in depth. Tab 43h connects with flange 43g at its upper end and is approximately ½ inch in depth and 5 inches long. The space between the bottom edge of flange 43h and bottom flange 43c is approximately 2 inches.

The opposite, right hand vertical panel generally designated 44 seen in the lower left center of FIG. 3 and to the right in FIG. 12 is exactly the same as the construction of member 43 except the inboard edge, flange and tab constructions are reversed, one side to the other. Accordingly, panel member 44 will have the parts thereof which are the same as the parts to member 43 numbered identically and such will not be redescribed. The dimensions of vertical side member 44 and the parts thereof are identical to the dimensions stated with respect to element 43 with the understanding that these are relative measurements to a specific situation which may be changed with respect to a different size zero clearance fireplace.

Looking at FIG. 17, therein is seen a normally horizontal panel or structural member generally designated 45 in FIG. 17. This number is used as the lowermost of the bottom set of horizontal elements (bottom 3) and, also, the lowermost horizontal element of the top three horizontal elements (top 3). The top member identical to the showing in FIG. 17 is generally designated 46 with like numbered parts for those to be described with respect to member 45 of FIG. 7, that is, like designated except under the numeral 46 rather than 45.

Referring, then, to FIGS. 3 and 17, particularly, member 45 has outer facing panel 45a. This facing and the entire member, as well as the like panel of member 46, is substantially 2 inches in height and 38 inches in width. There is a top, continuous, inboard directed flange 45b which extends at right angles to front panel 45a and is approximately ½ inch in depth. Opposed thereto is normally horizontal lower flange 45c running parallel to flange 45b, the former having normally vertically extending flange 45d on the inboard edge thereof. The depth of flange 45c including the thickness of flange 45d is preferably approximately ½ inch. The height of flange 45d may be approximately ½ inch. Again, as noted, member 46 is like numbered to member 45 as the pieces are identical and thus will not be redescribed.

Reference now is particularly made to the lower part of FIG. 5, the lower center of FIG. 3 (as well as the upper center thereof), the upper portion of FIG. 11 and FIG. 20. In FIG. 3 is seen (lower center) the first, lower set of louvres generally designated 47. Thereabove, top center, is seen the second, upper set of louvres generally designated 48. The louvre assemblies 47 and 48 are identical in construction. They consist of vertically spaced apart and downwardly slanted sets of louvre blades 47a and 48a. Normally vertical beams 49 (lower) and 50 (upper) have tabs as at 49a in FIG. 20 punched out centrally thereof adapted to receive the upper edges of louvre slats 47a (or 48a) thereon, such fixed thereto by rivets or bolts 49b. Beams 49 are laterally spaced apart from one another as may be seen in FIG. 3, as are beams 50 in the upper group or set 48.

FIG. 18 shows the inboard view of the topmost horizontal structural (or "top one") generally designated 51. Top member 51 has front panel 51a. Upper normally horizontal flange 51b is typically one inch deep. End flanges 51c and bottom flange 51d, also extending at right angles to face plate 51a, are preferably approximately ½ inch deep. The height of front panel 51a, including the thickness of flanges 51b and 51d, is approximately 6 inches.

Referring to FIG. 19, therein is shown the top panel member of the bottom three horizontal elements or "bottom one". This member has front panel face 52a, normally vertical. The length of member 52 from edge to edge is approximately 36 inches in the arbitrary scale here being set for example purposes. (The length of member 51, including the edge flanges 51c, is approximately 38 inches, the length of member 45 in FIG. 17 also being 38 inches.) Member 52 has lower, normally horizontal flange 52b which is preferably approximately ½ inch in depth. The top horizontal flange of member 52 has ½ inch deep end portions or sections 52c and 1 inch deep flange or portion 52d, so fashioned for purposes to be described. The width of member 52 is preferably approximately 36 inches. It also should be noted that the width of the louvre slats 47a and 48a are also approximately 36 inches in both cases.

ASSEMBLY OF THE FIREPLACE FRONT FACING

FIG. 3 shows all eight of the elements of the subject add-on facing (or facade) for a zero clearance fireplace front positioned with respect to one another in the manner or position that they would be assembled. In the particular figures of the drawings (and the following description), the assembly is described from the standpoint of first engaging vertical side member 43 to a certain extent with the fireplace edge, top and bottom and thereafter, one by one, assembling the horizontal elements with respect thereto from the bottom up. Only thereafter would the opposite vertical member 44 be used. It should be understood that the owner or operator can start with the right hand vertical member 44. Horizontal assembly may start with the bottommost horizontal member (of the lower three thereof) or with the lower member of the top three horizontals. The point is that one side vertical must be first engaged substantially with one side of the basic fireplace body and, thereafter, the three bottom horizontals or the three top horizontals, either one, selected, with each set installed from the bottom member of the bottom or top three on up for each given set.

Now turning to FIGS. 3 and 4, first, left hand vertical panel or structural member 43 is substantially engaged with the left hand side of the zero clearance fireplace front member 30 in the following manner. First, the elongate outboard vertical flange 43b is partially inserted into the gap or clearance between the vertical left hand side wall 32 of the fireplace opening and the left hand edge of front vertical side portion 38. At the same time, top flange 43d and bottom flange 43c are inserted, respectively, between (1) the top surround 33 and top of side portion 38 at the left hand side thereof and (2) the lower end edge of panel 38 or side portion 38 and the floor or fireplace opening floor thereunder. Yet further, elongate vertical inboard flange 43*g* is inserted in the gap between the left hand extreme of door portion 35 and under and above the lower and top edges, respectively, of horizontal front portions 39 and 41 of the zero clearance fireplace front. Tabs 43*f* and 43*h* extend flush with the front surface of vertical side portion 38, whereby approximately ½ inch (slightly less until final snapping in) of each one of flanges 43*d*, 43*b*, 43*c* and 43*g* extend inwardly past the outer faces of fireplace front portions 38, 39 and 40. Typically, initially, about a quarter inch or at most ⅜ths of an inch engagement would be employed and, optionally, face panel 43*a* may be angled slightly outwardly inwardly thereof so there is more fireplace engagement by flange 43*b* then by partial flange 43*g*.

At this juncture, following the showing of the drawings and referring first to FIG. 4, "bottom three" or "lower three", horizontal member 45 (FIG. 17), is moved up against the lowermost front face portion 41 of the basic fireplace, below louvres 42. Such first rests on the floor on flange 45*c* and then is lifted very slightly at the left hand end thereof (FIG. 3) to fit into the slot between flange 43*c* and tab 43*h* (the lower end thereof).

Secondly, after this first engagement, the louvre member 47 is implaced above flange 45*b* with the lower portions of beams or members 49 extending downwardly behind flange 45*b* of bottom member 45. It should here be noted that the width of the fireplace opening, from inboard edge of portion 37 to the inboard edge of portion 38 is 36 inches wide in this specific example being described. "Bottom three" member 45, being 38 inches long, is extended one inch on the left hand side past tab 43*h* and on top of bottom flange 43*c* of member 43. Louvre assembly 47, however, has louvre slats 47*a* thereof of a width only of 36 inches. Accordingly, the louvre slats 47*a* overlie flange 45*b* and abut, at their left hand end in FIG. 3, against the lower portion of tab 43*h*. The upper and lower extensions (FIG. 5) of members 49 behind member 45 (and also member 52 to be described) are thus held in place in the three bottom member array. Optionally, at this point, with member 49 engaged behind the inboard face of member 45 (upper flange 45*b* thereof) there may be received a self tapping screw in the top extension of vertical members 49 before the next horizontal piece (52) is applied. Louvre slats 47*a* overlie air intake lower fireplace slots 42 in the entire height of the latter.

Whether or not louvre member 47 has been screw attached to face 41, at this juncture, member 52 of FIG. 19 is next applied and attached or inserted with respect to the bottom array and the fireplace opening. It should be noted that member 52 is only 36 inches wide, whereby to abut, in the end portion thereof, against the topmost portion of lower tab 43*h* on member 43. In this engagement, the lower ½ inch width flange 52*b* lies over and abuts against the top portions of member 49, closely adjacent face 41. The deep portion 52*d* of top flange 52*c*, 52*d*, slides in to the fireplace opening 34 above the topmost edge of face 41 and below the bottommost edges of the doors 35 and 36 on the floor of the fireplace opening 34. The notches at 52*c* enable clearance of the outboard top portions of member 52 with respect to the peripheral door mounting posts 35*b* (see FIG. 9) and, if such doors 35 and 36 are present, also clearance of the outboard ends of door holding spring clips (not shown) which may be unscrewed at their outboard ends to permit insertion of flange portion 52*d* under the inboard ends thereof and then reinserted overlying same with their inboard free ends thus to aid in retaining flange portion 52*d* with respect to the fireplace opening floor.

At this point, the entire bottom element assembly (bottom 3, bottom 2 and bottom 1 (members 45, 47 and 52, respectively)) is engaged with (1) left hand vertical 43 (the left hand end of member 45), (2) both bottom 3 (member 45) and bottom 1 (member 52) are engaged, specifically, by the upwardly and downwardly extending portions 49 of member 47 fitting behind members 45 and 52 and (3) the floor of the fireplace opening (flange portion 52*d* of bottom 1 (member 52) being inserted under the doors or door panels 35 and 36. Thus, this group of elements is self sustaining in position without the right hand vertical panel or structural member 44 yet being engaged therewith.

Now turning to the assembly of the top three horizontal members, as previously noted, thus assembly is from the lower member or portion thereof upwardly. Accordingly, since member 46 is of the exact same dimensions as member 45, the left hand end thereof is enabled to fit in between the upper edge of deep flange 46*g* and the lower edge of shallow tab 43*f* on the inboard edge of left hand vertical side member 43. The extension past inboard edge 43*e* between the said flange and tab is approximately one inch, member 46 being 38 inches wide.

At this juncture, louvre member 48 (top 2) is inserted with respect to panel member 46 (top 1) in the exact manner that louvre member 47 was inserted with respect to bottom 3, horizontal panel member 45. Specifically, that is, the lower ends of attachment beams or strips 50 fit behind the top horizontal inwardly extending edge 46*b* of member 46 (see FIG. 11). The leftmost edge of louvre slats 48*a* abut against the tab 43*f*. Tab 43*f* is typically approximately 3 inches long, its lower edge being spaced approximately two inches above the upper end of deep flange 43*g*. Once again, if desired, self tapping screws may be used on the upper portions of members 50, therethrough into fireplace face 39.

At this point, the uppermost horizontal member 51 may be inserted into the assemblage. Member 51 is, in the specific example being described, 38 inches long. The free, inner half inch of enlarged upper flange 51*b* is inserted, slightly to the right of member 43, into the clearance gap between top surround 33 and upper furnace panel portion 39. This done, the member 51 is then moved laterally (to the left in FIG. 3 and FIG. 12) into the gap between the top of tab 43*f* and under the upper inward flange 43*d* of member 43 approximately one inch. Thus, the lower, half flange 51*d* of member 51 lies on the top edge of tab 43*f* with the full depth flange 51*b* underlying flange 43*d* and, in the right hand portion thereof, extending into the gap between surround 33 and the top of panel portion 39.

At this point, the entire engagement of left hand vertical member 43 with the fireplace is finalized with the upper, lower and outer flanges 43*d*, 43*c* and 43*b* being pushed into full engagement with the top, side and bottom periphery of the zero clearance fireplace on the left hand side thereof, with inboard flange 43*g* inserted its full distance outboard of or to the left of the left hand most portion of door panel 35 and to the right of the side wall of the fireplace opening 34. All six horizontal structurals or facing members are engaged as previously described, the bottom member of each set (both upper and lower sets) being engaged with member 43, the intermediate louvre assemblies 47 and 48 being engaged by their base members 49 and 50 with the panel members above and below the louvre slats 47*a* and 48*a* and, in the case of member 51, engagement by both member 43 and the top edge or wall of fireplace 30 is provided, comparing with the top partial flange 52*d* engagement of member 52 with the floor of the fireplace opening.

As previously noted, the illustrated original zero clearance fireplace, whose is face is seen in FIG. 1 and to the right in FIG. 3, is one employing a fan or blower system whereby both a lower set 42 of inlet slots or louvres for cool air is provided, as well as an upper set of slots, vanes or louvres 40 for output of heated air. In the event that there is not present the lower set of inlet ports 42, the fireplace owner has two options. In the first place, not preferred, he could employ the bottom three members 52, 47 and 45, as previously described and seen in FIG. 2, thus having a symmetrical (upper and lower) finished appearance upon full assembly (yet to be described) as seen in FIG. 2. Alternatively, the elongate tab 43*h* may be removed from member 43 (and its equivalent, 44*h*, from member 44), whereby to have an inch deep elongate space between the bottom of flange 43*g* (44*g*) and the top of floor flange 43*c* (44*c*). This distance is slightly over seven inches. In such case, a single horizontal member may then be employed with respect to the two vertical side members and the lower front furnace panel 41. This would be a uniform panel front face or sheet which would be approximately 7 inches high and 38 inches wide. The bottom flange (inboard to the fireplace opening) thereof would be structured in the same manner as flanges 45*c* and 45*d* of FIG. 17, that is, the same depth and height. The top flange of this monolithic panel member would be 38 inches wide in its rearmost half inch (like portions 52*c* of member 52) while the center full depth flange portion (like center flange 52*d* of member 52) would be of the width of the fireplace floor. The notches corresponding to those between portions 52*c* and 52*d* of member 52 would be one inch wider on each side than the notches of member 52 because of the greater length (38 inches) of the member being described.

In assembly of this member, it could be inserted first, thus immediately paneling the entire height of bottom front face portion 41 with its lower flange lying on bottom flanges 43*c*, 44*c* of the vertical members 43 and 44 and the top full depth flange portion underlying doors 35 and 36 and overlying the fireplace opening floor except where the notches would be provided to clear the posts mounting the door sections 35 and 36 and the spring members for retaining the doors 35 and 36 in closed position, if such are present. In the present useage, such members would also have the screws capturing one end of the door holding spring members unscrewed, then overlaid over the edges of the full depth flange portions with the inner free ends thereof and screwed back in place with the outer, attached portions thereof.

In any case, if there were no fireplace doors as are seen at 35 and 36, the deep flange 52*d* would be full width (36 inches) of the member 52. In the case of the single lower facing member, the full flange depth would be the width of the fireplace floor leaving one inch notches at each end thereof.

At this point, with whatever horizontal structurals are to be employed with a given fireplace facing being engaged as previously described, it is now necessary to engage and attach the right hand side member 44 (FIG. 12 and FIG. 3) with the right hand side of the zero clearance fireplace over portion 37 thereof. Looking, then, at FIGS. 3 and 12, particularly the latter, vertical member 44 is aligned with the right hand side of the fireplace, with the side thereof having tabs 44*f* and 44*h*, as well as flange 44*g* thereon, positioned as seen in FIG. 12. The member 44 is then moved forwardly to engagement with the various members of the facing horizontals and the right hand portions of the zero clearance fireplace as will now be described.

Starting at the top end, first, flange 44*d* is inserted into the gap between top surround 33 and the upper edge of fireplace panel 39. Also, flange 44*d* fits over one inch of the outboard right edge of flange 51*b*. Simultaneously, the deep outer flange 44*b* (FIG. 3) is inserted in the gap between surround 31 and the right hand side or edge of facing fireplace panel portion 37. Also simultaneously, the lower flange 44*c* is moved forwardly and inserted under the right hand end of member 45 and the lowermost portion of the zero clearance fireplace. Now, starting upward on the left hand edge of member 44 (FIG. 12), tab 44*h* abuts against the right hand edges of louvre slats 47*a* and member 52. Flange 44*g* is inserted between the right hand end of doors 36 and the vertical right hand side wall of the fireplace opening 34 (left hand edge of vertical facing portion 37). Simultaneously, the tab 44*f* is inserted over the top edge of horizontal 46 and below the bottom edge of horizontal 51 against the right hand edges of louvre slats 48*a*. The right hand extensions of members 46 and 51 thus fit into and behind the left hand edge 44*e* of member 44 above and below tab 44*f*.

Once the entire assembly has been fully assembled and integrated by pushing in or snapping in the two vertical side members 43 and 44 as previously described, the panel facing or facade as in FIG. 2 is entirely completed and it may be seen that no part of the (conventionally) black metal front facing 38, 39, 37 and 41, nor vents 40 and 42, are seen. In the event that the horizontal and vertical paneling, facing or facade members are brass, brushed steel, or other attractive metal, an entirely newly faced fireplace front has been provided of extremely attractive appearance, such appearance having been achieved far more cheaply than the cost of originally fabricating a decorative metal front integral with the basic zero clearance fireplace construction. It should also be noted that, at this time, if it is desired, self tapping screws may be driven through panels 43*a* and 44*a* adjacent the upper and lower portions of inboard flanges 43*g* and 44*g*. This, in combination with the use of self tapping screws with the louvre slat assemblies, as described as a previous option, will unquestionably securely fix the members of the assemblage together in engagement with one another and the fireplace front elements. The vertical side member screws may be used in conjunction with the louvre slat vertical member screws or either of them separately. None of such optional screws are absolutely required for adequate assembly and retaining of the facing members on the fireplace front.

If it is needed to have access to, say, the lower portion of the fireplace facing at 41, say with respect to access to or behind vents 42, either member 43 or member 44 may be disengaged from the recited horizontal members and fireplace peripheral portion engagements. Any self tapping screws that have been employed would be removed. Then, the horizontal members 52, 47 and 45 (if desired) may be removed for access to the front panel of the lower fireplace front facing. Any self tapping screws employed with the upper portions of members 49 would also be removed to be able to remove the louvre slat section 47.

Should it be desirable for the entire facade or facing of the zero clearance fireplace unit to be removed for cleaning, polishing or replacement by another, different appearing metal facing, such may be done at any time, using the reverse of the described assembly procedures. Dissasembly, after one side member 43 or 44 is removed, can be undertaken from the top member 51 down or member 52 of the lower horizontal first and then thereof the top portion after all three lower horizontals have been removed. In the first case, top one is first removed, then top two, then top three. Alternatively, bottom one is first removed, then bottom two and then bottom three.

FIGS. 21–24, INCLUSIVE

The above noted four figures show a major variation in the fireplace facade or facing for the front wall of a zero clearance fireplace as previously set forth and described. This particular construction and assembly has certain advantages over the structures of the previous figures, but also certain disadvantages. As an advantage, instead of six horizontal members (see FIG. 3), as few as two horizontal members may be employed. This makes for much swifter and easier assembly of the parts as a facade or facing. On the other hand, because the slots or louvres in the constructions to be described are formed out of a metal sheet, it is very difficult or impossible to provide the formed, louvre carrying upper and/or lower horizontals of FIGS. 21–25 with front sheets of perfectly flat, entirely undistorted metal. On the other hand, in the construction seen in FIG. 3 with the separate louvre sections 47*a* and 48*a*, these louvres and the panel members above and below them (at the top and bottom of the firebox) may be absolutely straight and undistorted for a most attractive appearance of the said louvres.

It is important to realize the following:

(1) Either the top or bottom member of the two horizontals in FIGS. 21–25, inclusive may be used together as seen in the noted figures or as a top or bottom horizontal member in the assembly of FIG. 3. (Thus, for example, members 45*a*, 47*a* and 52*a* may be replaced by the bottom horizontal single member to be here described. Likewise, members 46*a*, 48*a* and 51*a* may be replaced by the top horizontal member seen in the view of FIGS. 21–25, inclusive.

(2) Further, it is not necessary that either the top or bottom horizontal members of FIGS. 21–24, inclusive, or either of them, separately, have the depicted louvres or slots formed therewithin which are seen in the views of FIGS. 21 and 22 and 24 and 25. Thus, if the fireplace has no air circulating means above or below the firebox, both front panels of the horizontals of the FIGS. 21–25, inclusive may be flat plane fronted. If there is air draw or circulation only at the top or bottom, either the top or bottom horizontal member of the fireplace, where the ventilation is needed, need be slotted or louvred.

Turning to FIGS. 21 and 22, at 100 and 101 are seen the vertical side panels of the front facade or face of a zero clearance fireplace. These vertical panels may be of considerable or very much lesser width. At 102 is seen the top horizontal of the zero clearance fireplace having (optional) slots or louvres 103 therewithin. The lower horizontal 104 below the firebox (to be described) of the zero clearance fireplace is hidden in the views of FIGS. 21 and 22 behind the first horizontal add-on facing or facade member and may or may not have louvres or slots (unnumbered) therewithin. However, the lower horizontal panel of the zero clearance fireplace is generally indicated at 104.

The firebox 105 has top wall 106, side walls 107 and floor or bottom wall 108. The latter, in FIG. 21, is shown with the leading edge thereof covered by the top flange of the lower horizontal, to be hereinafter discussed.

Looking at FIG. 23, therein is seen the left vertical panel facade or facing member of FIGS. 21 and 22 seen from the rear. Such is generally designated 109, having facing panel 110, top full depth flange 111, left hand (in the position of FIG. 21) full depth flange 112 and bottom full depth flange 113. On the opposite edge 114 of panel 110, there is provided an elongate full depth flange 115 which is adapted to fit into the vertical left side of the firebox 105 as seen in FIGS. 21 and 22. This construction is identical to that of FIG. 16, save for the fact that the partial depth flanges 43*f* and 43*h* have been removed. In the showing of FIG. 22, on the right hand side showing the right hand vertical facade structural, all the parts common to the showing of FIG. 23 are numbered the same, but primed.

Now looking at FIG. 24, therein is seen the right hand portion of the lower horizontal member seen in FIGS. 21 and 22. This member is generally designated 116 and has front panel 117. Front panel 117 may have slots or louvres 118 formed therewithin. Top flange full depth portion 119*a* has half depth portion 119*b* associated therewith at both ends of the lower horizontal. Half depth side wall 120 joins half depth bottom flange 121 at its lower end as well as the half depth top flange portion 119*b* at its upper end.

The upper flange 119*a*, 119*b* is the same as the top flange of member 52 in FIG. 19. The action in implacement of this member is the same as with respect to flange portions 52*d* and 52*c* of member 52. That is, the full depth flange 119*a* overlies the bottom floor of the firebox 105 at 108 out closely adjacent the post 122*a* that mounts the doors 122 in the firebox.

In FIGS. 21 and 22, doors 122 and 123 are mounted at the right and left hand extremities thereof on posts 122*a* and 123*a* which engage into the firebox floor 108 and ceiling 107. The structure and action of the fireplace doors of FIGS. 21 and 22 are the same as those seen in earlier figures at 35 and 36. The width of horizontal lower member 116 is greater, by an inch or so than the firebox as may be seen in FIGS. 21 and 22 at 120 and 120′. Thus, as may be seen to the left in FIG. 21 and 22 the left hand extension 120′ of horizontal member 116 is overlaid by the right hand edge of left hand vertical structure 110. The panel portion 110 overlying 120′ has been cut away in FIG. 21 to show how the left hand edge 120′ extends past the left hand vertical side 107′ of the firebox 105. In FIG. 22 it may be seen in dotted lines in the lower left hand corner of the figure. In the right hand portion of FIG. 22, it can be seen that edge 114′ will overlay a portion of the end 120 of lower horizontal 116.

Looking at FIG. 25, therein is shown the right hand side of the upper horizontal member of the facade shown partially applied in FIG. 22 at the top center. The construction of the member seen in FIG. 25 is extremely like that of member 51 in FIG. 18, with the exception that it is of much greater height than member 51 and, additionally, louvres or slots are optionally formed in the front panel thereof.

Turning, then, to the top horizontal of FIGS. 22 and 25, front panel 125 optionally has slots or louvres 126 formed therewithin. Along the top edge of front panel 125 there is provided a full depth top flange 126 which runs the entire length of front panel 125. Half depth side flanges 127 join full depth top flange 126 at the top end thereof and half depth flange 128 at the bottom of panel 125. We are looking, in FIG. 25, at the rearward side of the panel 125 seen from the front view in FIG. 22.

The purpose of the top flange 126 is to overlie the top edge (top front edge) of the zero clearance fireplace, specifically, the top of horizontal portion 102. The further purpose is to underlie the inward edges 114 of vertical members 109 and 109'.

Thus it can be seen how the assemblage of the four elements of FIGS. 21–25, inclusive may be accomplished. First, the vertical 109 is placed essentially in final position but with a clearance between the front panel 110 and the front face of the zero clearance fireplace. With this the case, then member 116, the lower horizontal, can be fitted in so that its center full depth flange **119*a* overlies the firebox lower floor 108, with the notched end portions 119*b* clearing posts 122*a* and 123*a*, as well as any clips fastened to the front of the firebox door, such clips being useable, if sized rightly, to also overlie the full depth flange portions 119*a* next to the notched portions 119*b*. The half depth side walls 120 and 120', as well as the half depth bottom wall 121 abut against the front face of the zero clearance fireplace on lower horizontal portion 104 and vertical portions 100 and 101 being overlaid by the side half depth walls 120 and 120'**.

In the case of member 124, the full depth flange 126 overlies the top wall of the zero clearance fireplace in zone 102 thereof, as well as the inboard edges of portions 100 and 101 thereof. That is, the lateral walls 127 and 127' of member 124 extend past the side vertical edges of the firebox 105. Then, when vertical left hand member 109 is fully forced into place abutting the front panels 117 and 125 of the upper and lower horizontals (missing the lateral ends of the slots or louvres 118 and 126), the left hand closure is made. Thereafter, as seen in FIG. 22, the right hand vertical 109' is moved forwardly in the view so that bottom flange 113' underlies the floor or bottom wall of the zero clearance fireplace, as well as lower edge 121 of member 116. The flange 115' fits into the firebox to the right of doors 122, extending the substantial height thereof from the floor of the firebox to the top wall thereof and the top flange 111' overlies both the top wall of the zero clearance fireplace and the right hand edge of horizontal sheet 125. The (unseen) edge 112' fits along the right hand vertical side of the zero clearance fireplace as seen in FIG. 22.

As previously mentioned, one or both of the front panels 117 and 125 may omit the slots or louvres 118 and 126. Yet further, as previously stated, the lower horizontal 117, with or without louvres 118 may be employed as the lower horizontal member with the top horizontals being made up of **46*a*, 48*a* and 51*a* as seen in FIG. 3. In this latter case, the half flange 43*f* of FIG. 16 would have to be employed. Alternatively, the top member of FIG. 25 may be employed, with or without louvres 126 while members 45*a*, 47*a* and 52*a* (FIG. 3) are employed as the lower horizontal members. In this case, again, the verticals 109 and 109' would necessarily have to have half depth flanges in the manner of 43*h* of FIG. 16** for this useage.

What has been provided with respect to all of the forms of the subject invention is a decorative facade or facing for the front wall of a zero clearance fireplace. The zero clearance fireplace front wall typically comprises a substantially rectangular, vertical, sheet metal front with substantially parallel, normally horizontal, top and bottom edges and substantially parallel, normally vertical, side edges. The top wall, side walls and bottom wall of the zero clearance fireplace typically run rearwardly from the fireplace front wall at substantial right angles thereto from the said edges thereof.

A firebox is typically provided in said zero clearance fireplace having a normally substantially vertical rear wall, normally substantially vertical side walls and normally substantially horizontal top and bottom walls. The front edges of the firebox side, top and bottom walls open out of the fireplace front wall as a substantially rectangular opening defined by the front edges of the firebox walls.

With this structure there are typically two elongate, laterally spaced apart, substantially rectangular, vertically extending side panels of the fireplace front wall positioned laterally outboard of said firebox front opening, one on each side thereof. There is further provided two elongate, vertically spaced apart, horizontally extending, substantially rectangular top and bottom panels of the fireplace front wall positioned above and below the top and bottom front edges of the firebox and connecting, at their outer edges, with the fireplace front wall rectangular side panels.

Two basic facade or facing systems for this fireplace construction have been shown in the description of the previous constructions. The first of these is the construction basically seen in FIG. 3 where a plurality of lower horizontal and upper horizontal members are utilized with specially formed vertical side members to make up a facing array particularly adapted to a zero clearance fireplace front having two sets of louvres or slots 40 and 42 therewith. In FIG. 22, there is seen the alternative to one or both of the upper and lower horizontal members of the system of FIG. 3 (also FIG. 12 and FIG. 2). This comprises one or more horizontal upper and lower members (with or without slots or louvres 118 and 126) used in conjunction with one another or with one of the horizontal multiple member systems seen in FIG. 3, etc. Thus there has been provided the greatest versatility possible with respect to applying a facade or facing to a zero clearance fireplace already in place.

From the foregoing, it will be seen that this invention is one well adapted to attain all of the ends and objects hereinabove set forth together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

I claim:

1. A decorative facade or facing for the front wall of a zero clearance fireplace, said zero clearance fireplace front wall normally received and standing in a vertical plane and including a substantially rectangular, vertical, sheet metal fronting, said fronting made up of one top, two side and one bottom front wall portions and having substantially parallel, normally horizontal, outboard top and bottom edges and substantially parallel, normally vertical, outboard, front side edges on the respective wall portions, (1) the top wall, side wall and bottom front wall portions of said zero clearance fireplace front wall all having the outboard edge portions thereof running rearwardly from said zero clearance fireplace front wall at substantial right angles thereto, (2) a firebox provided in said zero clearance fireplace having normally substantially vertical side walls and normally substantially horizontal top and bottom walls, each of said side, top and bottom walls having a front edge thereof, (3) the front edges of the firebox side, top and bottom walls opening out of the zero clearance fireplace front wall as a substantially rectangular opening, (4) there being two elongate, laterally spaced apart, substantially rectangular, vertically extending side panels of the zero clearance fireplace front wall positioned laterally of said firebox front opening, one on each side thereof, (5) there further being two elongate, vertically spaced apart, horizontally extending, substantially rectangular top and bottom panels of the zero clearance fireplace front wall having side, top and bottom edges positioned respectively above and below the top and bottom front edges of said firebox and connecting, at their said side edges, with said fireplace front wall rectangular side panels;

(6) said facade comprising, in combination, (a) a pair of opposed, first and second, vertical facade side panel members adapted to fit over and lie against the said zero clearance fireplace front wall side panels, (7) each said facade side panel member made up of:

(a) a rectangular front sheet adapted to overlie one of said zero clearance fireplace front wall side panels, (b) said facade side panel front sheets each having top, bottom and outer side elongate edge members extending rearwardly therefrom at substantial right angles to said front sheet, said top, bottom and outer side edge members, respectively, fitting over the said outer front edge portion of the zero clearance fireplace top wall, under the said outer, front, bottom edge portion of the fireplace bottom wall and vertically along the said outer side edge portions of a zero clearance fireplace side wall portion, said elongate edge members fixed to the top, bottom and outer side edges of said facade side panel front sheet, (c) there being an elongate, rearwardly directed, inner in board side flange member provided on each facade side panel member positioned at substantial right angles to the front sheet thereof and opposed to the said side elongate edge member on said facade side sheet, (d) each said inner inboard flange member so positioned and so sized as to fit into the firebox at one side wall thereof, and also fit against a firebox side wall along the substantial height of the firebox adjacent the front edge thereof and spaced downwardly and upwardly from the top and bottom edges of the facade side first and second panels, the height of said inner side flange member being equal to the firebox height and less than the height of said side panel, (e) first lower and second upper, opposed opening gaps below and above each of said inner side flange members, the upper opposed gaps each being the substantial height of the top horizontal panel of the zero clearance fireplace front wall and the lower opposed gaps being the substantial height of the lower horizontal panel of said fireplace front wall, (8) an elongate, upper, horizontally extending, overlying, substantially rectangular third facade panel having top and bottom horizontal rearwardly extending flanges fixed to the top and bottom thereof, such flanges extending at substantial right angles to said third facade panel rearwardly thereof and of such length as to be insertable at the side ends thereof into the second, upper, opposed, inboard gaps of the facade side panel members and at least partially under said facade side panel front sheets, said upper horizontal panel so sized as to fully cover the fireplace front wall top horizontal panel, (9) the said upper and lower horizontal edges of said facade third panel inboard flange members operative at least to space the third facade panel at least somewhat away from the zero clearance fireplace front top wall and abutting thereagainst,

(10) an elongate, lower, horizontally extending, overlying, substantially rectangular fourth facade panel having top and bottom edge rearwardly extending flanges fixed to the respective top and bottom edges thereof and extending at substantial right angles to said fourth facade panel means,

(11) said fourth facade panel being insertible at the ends thereof in the lower, first, opposed gaps of the facade side panel members and so sized as to cover the fireplace front wall bottom horizontal panel and extend into said first gaps,

(12) the said top and bottom flanges of said lower fourth facade panel means at least abutting against the bottom front face of the zero clearance fireplace front wall whereby to space said panel somewhat from said front wall.

2. A decorative facade or facing as in claim 1 wherein the upper, horizontally extending, overlying, substantially rectangular facade third panel means adapted to cover the fireplace front wall top horizontal panel has extended, rearwardly extending, horizontal flange means on the top edge thereof, such adapted at least in part thereof to overlie at least in part the top edge of the upper wall portion of said zero clearance fireplace and aid in supporting said facade third panel means with respect to said fireplace front wall.

3. A decorative facade or facing as in claim 1 wherein the lower, horizontally extending, overlying, substantially rectangular facade fourth panel means adapted to cover the fireplace front wall bottom horizontal panel has additional, rearwardly extending, horizontal flange means at the upper edge thereof further extending at substantial right angles to said rectangular panel means, said flange means adapted to fit in part thereof or at least a portion of the lower front edge of the firebox bottom wall and aid in supporting said facade fourth rectangular panel means with respect to the front of said zero clearance fireplace.

4. A decorative facade or facing as in claim 1 wherein the upper, horizontally extending, overlying, substantially rectangular panel means adapted to cover the fireplace front wall top horizontal panel has rearwardly extending, horizontal flange means on the top edge thereof adapted to overlie at least in part the top wall of said zero clearance fireplace and aid in supporting said panel means with respect to said fireplace front wall, said upper, horizontally extending, overlying and substantially rectangular panel means that is adapted to cover the fireplace front wall top horizontal panel having slots formed in the face thereof between the upper and lower edges thereof for passage of air therethrough.

5. A decorative facade or facing as in claim 1 wherein the lower, horizontally extending, overlying, substantially rectangular facade-correction panel means adapted to cover the fireplace front wall bottom horizontal panel has rearwardly extending, horizontal flange means at the upper edge thereof extending rearwardly and at substantial right angles to said rectangular panel means, said flange means adapted to fit at least in part thereof over at least a portion of the lower front edge of the firebox bottom wall and aid in supporting said rectangular panel means with respect to the front of said fireplace, the lower, horizontally extending, overlying, substantially rectangular panel means adapted to cover the fireplace front wall bottom horizontal panel having slots formed therewithin intermediate the upper and lower edges thereof adapted to pass air therethrough.

6. A facade or facing as in claim 1 wherein said upper, horizontally extending, overlying, substantially rectangular facade panel means that is adapted to cover the fireplace front wall top horizontal panel has slots formed in the face thereof between the upper and lower edges thereof for passage of air therethrough.

7. A facade or facing as in claim 1 wherein the lower, horizontally extending, overlying, substantially rectangular facade panel means adapted to cover the fireplace front wall bottom horizontal panel has slots formed therewithin intermediate the upper and lower edges thereof adapted to pass air therethrough.

8. A facade or facing as in claim 1 wherein the upper, horizontally extending, overlying, substantially rectangular facade panel means that is adapted to cover the fireplace front wall top horizontal panel and the lower, horizontally extending, overlying, substantially rectangular facade panel means adapted to cover the fireplace front wall bottom horizontal panel each have slots formed therewithin intermediate the upper and lower edges thereof adapted to pass air therethrough.

9. A facade or facing as in claim 1 wherein there is provided, in each of the upper opposed gaps above the inboard flange members, a first partial flange of approximately one half the depth of the inboard flange members, said partial flange also extending at substantial right angles to the front sheet, there being gaps provided above and below said partial flange member, such gaps positioned one above the inboard flange member upper end and the other such gap positioned below the top edge member and above said partial flange, said partial flanges adapted to lie, with the inboard edges thereof, against the front upper wall of the fireplace above said firebox, there being a first, elongate, horizontal panel member adapted to fit in the gap between the top edge of the inboard flange member and the bottom edge of the said first partial flange member, there also being a set of somewhat downwardly angled horizontal louvre members held together in substantially parallel, vertically spaced apart position by a plurality of vertical beams fixed to and extending above and below said louvres, the louvres being of such length as to extend between and abut against the said first partial flanges with the lower ends of said vertical beams extending downwardly behind the said horizontal panel member received above said inboard flange member, and there being an upper, horizontal outwardly facing panel member long enough to extend at its side edges under the top portions of the rectangular front sheets of the vertical side panels at the inboard sides thereof, said upper horizontal member having side and bottom inboard flanges adapted to lie against the fireplace upper front wall, the lower inboard edge of said upper horizontal panel member receiving therebehind the upper portions of the vertical beams holding the louvres together and apart and at least a portion of the top horizontal edge of the upper horizontally extending panel being of sufficient depth to partially overlie the front wall of said fireplace.

10. A decorative facade or facing as in claim 1 wherein the lower opposed gaps below said inboard flange members each have a second, partial flange member in said gap of lesser depth than said inboard flange members, such second partial flange members extending from the lower edge of the inboard flange members downwardly to a position spaced somewhat above the bottom elongate edge member of said front sheet, a first, bottom, horizontally extending front panel having upper and lower rearwardly extending edges at substantially right angles to said panel and such being of sufficient length to be able to lie under, at each side edge thereof, the rectangular front sheet of each side panel member and below the lower end of said second partial flange in said lower gap, a top panel member of a length sufficient to abut against the second partial flanges in said lower gaps at the outer side edges thereof, such upper panel having a lower edge adapted to abut the fireplace front wall and an upper flange portion of sufficient depth to slide into and overlie said firebox bottom wall in a portion of the length thereof, a plurality of substantially parallel, horizontally running, somewhat downwardly angled louvres, said louvres held together by upwardly and downwardly extending rear beam members, the lower and upper portions of each beam member extending respectively above and below said louvres and adapted to be respectively received behind the top edge of the lower panel member and the bottom edge of the upper panel member whereby to position said louvres between the top and bottom panel members, said louvres being sufficiently long to lie against, in the side edges thereof, the lower portions of the second partial flange members.

11. A facade or facing as in claim 1 wherein there is provided, in each of the upper opposed gaps above the inboard flange members, a first partial flange of approximately one half the depth of the inboard flange members, said partial flange also extending at substantial right angles to the front sheet, there being gaps provided above and below said partial flange member, one such gap positioned above the inboard flange member upper end and the other such gap positioned below the top edge member and above said partial flange, said partial flanges adapted to lie, with the inboard edges thereof, against the front upper wall of the fireplace above said firebox, there being a first, elongate, horizontal panel member adapted to fit in the gap between the top edge of the inboard flange member and the bottom edge of the said first partial flange member, there also being a set of somewhat downwardly angled horizontal louvre members held together in substantially parallel, vertically spaced apart position by a plurality of vertical beams fixed to and extending above and below said louvres, the louvres being of such length as to extend between and abut against the said first partial flanges with the lower ends of said vertical beams extending downwardly behind the said horizontal panel member received above said inboard flange member, and there being an upper, horizontal, outwardly facing panel member long enough to extend at its side edges under the top portions of the rectangular front sheets at the inboard sides thereof, said upper horizontal member having side and bottom inboard flanges adapted to lie against the fireplace upper front wall, the lower inboard edge of said upper horizontal panel member receiving therebehind the upper portions of the vertical beams holding the louvres together and apart and at least a portion of the top horizontal edge of the upper horizontal extending panel being of sufficient depth to partially overlie the front wall of said fireplace, the lower opposed gaps below said inboard flange members each having a second partial flange member in said gap of lesser depth than said inboard flange members, such second partial flange members extending from the lower edge of the inboard flange members downwardly to a position spaced somewhat above the bottom elongate edge member of said front sheet, a first, bottom, horizontally extending front panel having upper and lower rearwardly extending edges at substantial right angles to said panel and such being of sufficient length to be able to lie under, at each side edge thereof, the rectangular front sheet of each said side panel member and below the lower end of said second partial flange in said lower gap, a top panel member of a length sufficient to abut against the second partial flanges in said lower gaps at the outer side edges thereof, such upper panel having a lower edge adapted to abut the fireplace front wall and an upper flange portion of sufficient depth to slide into and overlie said firebox bottom wall and a portion of the length thereof, a plurality of substantially parallel, horizontally running, somewhat downwardly angled louvres, said louvres held together by upwardly and downwardly extending rear beam members, the lower and upper portions of each beam member extending respectively above and below said louvres and adapted to be respectively received behind the top edge of the lower panel member and the bottom edge of the upper panel member whereby to position said louvres between the top and bottom panel members, said louvres being sufficiently long to lie against, in the side edges thereof, the lower portions of the second partial flange members.

12. A decorative facade or facing as in claim 1 wherein the upper, horizontally extending, overlying, substantially rectangular facade panel means adapted to cover the fireplace front wall top horizontal panel has rearwardly extending, horizontal flange means on the top edge thereof adapted at least in part to overlie at least in part the top wall of said zero clearance fireplace and aid in supporting said panel means with respect to said fireplace front wall, the lower, horizontally extending, overlying, substantially rectangular facade panel means adapted to cover the fireplace front wall bottom horizontal panel having rearwardly extending, horizontal flange means at the upper edge thereof extending rearwardly and at substantial right angles to said rectangular panel means, said flange means adapted at least in part to fit over at least a portion of the lower front edge of the firebox bottom wall and aid in supporting said lower rectangular facade panel means with respect to the front of said fireplace.

13. A facade or facing as in claim 12 wherein said upper horizontally extending, overlying, substantially rectangular facade panel means that is adapted to cover the fireplace front wall top horizontal panel and the lower, horizontally extending, overlying, substantially rectangular facade panel means adapted to cover the fireplace front wall bottom horizontal panel each has slots formed therewithin intermediate the upper and lower edges thereof adapted to pass air therethrough.

* * * * *